United States Patent [19]

Gomoll et al.

[11] Patent Number: 4,609,294

[45] Date of Patent: Sep. 2, 1986

[54] ADJUSTMENT OF PRINT POSITION

[75] Inventors: Günter Gomoll, Nersingen-Leibi; Wolfgang Hendrischk, Neu-Ulm, both of Fed. Rep. of Germany

[73] Assignee: Mannesmann Aktiengesellschaft, Duesseldorf, Fed. Rep. of Germany

[21] Appl. No.: 253,875

[22] Filed: Apr. 13, 1981

[30] Foreign Application Priority Data

Apr. 15, 1980 [DE] Fed. Rep. of Germany ..... 3014823

[51] Int. Cl.[4] ..... B41J 25/30; B41J 11/20

[52] U.S. Cl. ..... 400/59; 400/56; 400/57

[58] Field of Search ..... 400/56, 57, 59, 611

[56] References Cited

U.S. PATENT DOCUMENTS 4,024,940 5/1977 Hendrischk et al. ..... 400/59 X
4,086,997 5/1978 Wu ..... 400/59 X
4,178,106 12/1979 Mailer et al. ..... 400/57
4,189,244 2/1980 Harrison ..... 400/59 X
4,218,151 8/1980 Kondur ..... 400/185 X
4,259,026 3/1981 Hanaoka et al. ..... 400/185 X

*Primary Examiner*—Paul T. Sewell
*Attorney, Agent, or Firm*—Ralf H. Siegemund

[57] ABSTRACT

The platen roller in a matrix printer is mounted to the printer case so that stop plates of the mount define a representation of the disposition of the roller. A frame is provided to hold a guide rod on which rides a carriage, and the print head is secured to that carriage. Adjustable cams on the rod abut the stop plates when the frame is slid into the case to, thereby, establish the distance between head and platen. The frame carries also the head drive, its motor and the paper-feed motor, there being a key connection to the platen, maintaining a driving connection even for different cam adjustments and frame positions in the case.

3 Claims, 2 Drawing Figures

ADJUSTMENT OF PRINT POSITION

BACKGROUND OF THE INVENTION

The present invention relates to a matrix printer and, more particularly, to improvements in a subassembly of such a printer, involving a movable print head and a platen.

Matrix printers usually include a platen, such as a roller, which serves also as a part of the paper feed, and a carriage is movably mounted on a rod for traveling across that platen. The carriage carries the print head which has a particular distance from the platen in any position of the carriage on the rod.

U.S. Pat. No. 4,024,940 discloses a construction for maintaining constant the distance of the print head from the sheet or web being printed upon. The print head is adjustably mounted on the carriage and is biased by means of a spring which bears against the head and the carriage to, thereby, adjust automatically the distance from the sheet under utilization of a feeler or scanner.

DESCRIPTION OF THE INVENTION

It is an object of the present invention to provide for a new and improved adjustability of the distance between a matrix print head and a platen roller without requiring an adjustment of the head on a carriage which moves the head across the platen.

It is another object of the present invention to simplify construction of matrix printers without, however, abandoning the possibility of adjustment of the printer as to the sheet's thickness, which adjustment does not have to be an automatic one in an economical printer model.

In accordance with the preferred embodiment of the present invention, it is suggested to journal the platen roller in the case and under utilization of stop means, or the like, which represent the roller position. The print head is secured to a carriage which, in turn, rides on a rod, and the rod is mounted in a frame that can be slid into the case, in a direction which is parallel to the direction of printing which is transversely to the direction of extension of the rod. The frame is provided with means such as cams on the rods which will engage the stop means to, thereby, establish the distance of the print head from the platen roller. The frame will carry also the head and carriage drive motor, and, preferably, also the drive means for the paper advance and for the ink ribbon. A key connection in a driving train is established here for the paper feed which connection is invariant to slight adjustments in the relative position between frame and case.

It can thus be seen that the adjustment of the print head distance is obtained by adjusting, e.g., the cams in the frames without having to adjust the position of the print head on the carriage which can thus be a secured one. This presents a significant advantage because adjusting mechanisms on a movable part (the carriage) which are subjected to significant acceleration and deceleration forces under observance of requisite accuracy are very complicated and costly since many precision parts are needed. The invention obviates the need for this adjustment. Also, the head and carriage can be made lighter which is beneficial as the power of the head drive can be reduced. Another advantage flows from the fact that the frame and all of its parts and appendices can be separately manufactured and assembled. Only a limited number of parts is directly assembled at and in the case.

DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings, in which:

Figure 1:
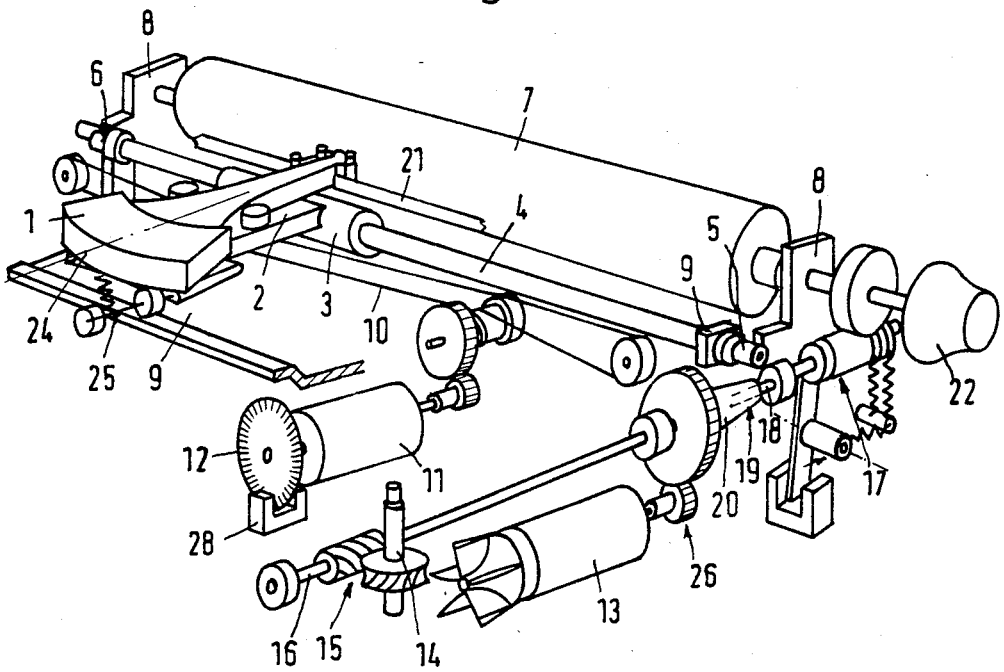
FIG. 1 is a perspective view of a portion of a printer improved upon in accordance with the preferred embodiment of the invention for practicing the best mode thereof.

Proceeding now to the detailed description of the drawings, the portion of a printer illustrated here includes a matrix print head 1 which is secured to a carriage 2. The front portion of the carriage includes a guide sleeve 3 by means of which the carriage runs on a rod 4 as the sleeve rides on that rod. A platen roller 7 extends in parallel to the rod 4. The platen roller is a friction roll participating also in the paper feed and advance. Reference numeral 24 denotes an axis along which head 1 prints. The print distance between the head and the platen 7 is taken along that axis and direction 24.

Roller 7 has shaft ends being journalled in plates 8 being parts of the print case. The rod 4 carries on its end excentric cams 5 and 6. These cams can be turned on the rod and, due to their eccentricity, differently long cam portions extend from the axis of rod 4 toward stop plates 8 of the case. The guide rod 4, moreover, is mounted in a frame 9 being slid into the case. Springs 23 urge the cams 5 and 6 against particular surface portions of the stop plates 8; the springs to be acting between the plates 8 and the frame 9. The plates 8 represent the disposition of the platen roller surface in the case. The cams 5 and 6, upon engaging plates 8, establish the distance between the axis of guide rod 4 and plates 8 to, thereby, establish the relative disposition and distance of the head 2 from platen 7.

The carriage 2 is connected to a cable 10; and a main or principal motor 11 is drivingly connected to that cable, via a gearing, to move the carriage with print head 1 on rod 4 and across the platen 7. A slotted disk 12, or the like, is mounted on the shaft of motor 11, and a scanner 28 (light barrier) produces clock pulses as the disk rotates. The pulses identify print positions and are signaled to a control circuit (not shown).

A second or secondary motor 13 is provided for driving an ink ribbon system (ink ribbon 21) and paper feed 17. Gearing 26 and free-wheeling; one-way clutches connect the shaft of motor 13 for one direction of rotation to a shaft 16 cooperating with a gearing 15 in order to drive a key shaft 14, the key to be inserted into a cassette for an ink ribbon. This mode of operation occurs during printing. The cassette for ink ribbon 21 is not shown, but is also mounted on frame 9.

A shaft 18 has one squared end to be received by a maching square-shaped bore in and of a sleeve 20. This key connection 19 constitutes a positive connector coupling which, however, permits parts 20 and 18 to undergo some axial displacement without interrupting the driving connection from motor 13 to paper feed gear 17. The sleeve 20 is actually driven by and from motor 13 when rotating in the opposite direction. In that case, gearing 17 will drive the platen roller 7 in order to obtain paper feed and advance, e.g., in steps. The platen roller 7 can, in addition, be turned manually by a manually operated knob 22 which is connected to the platen shaft by a one-way clutch, e.g., whenever the knob 22 is pushed in.

The frame 9 is not only provided for mounting rod 4 but also the main motor 11 and the support structure for the drive of cable 10. Furthermore, frame 9 carries a support rail 25 on which run rollers of the carriage 2 to obtain a balanced support. The frame 9 contains also the motor 13 with gearing 15 and shaft 16; the cassette for the ink ribbon 21 may also be mounted in that frame 9.

It can thus be seen that, as frame 9 is placed into the case, sleeve 20 is plugged onto the key end of shaft 18 while cams 5 and 6 bear against plates 8. The exact disposition depends upon the (rotational) adjustment of the cams 5 and 6 which, thus, permit a variable disposition of the print head relative to the platen roller 7. The key connection 19 is maintained as some (axial) shafts of sleeve 20, relative to shaft 18, are permitted provided, of course, that the axial key length is sufficient. Even after the frame 9 has been installed, turning adjustment of cams 5 and 6 on rod 4 permits a change of the distance between print head and platen 7 without interrupting the driving connection between motor 13 and paper feed gear 17.

Figure 2:
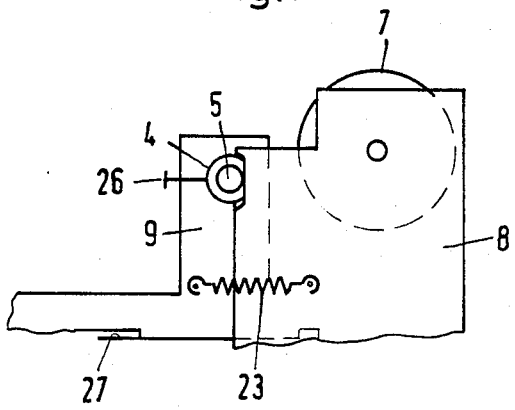
FIG. 2 is a detail of that printer in plan view.

FIG. 2 reveals that springs, such as spring 23, positively maintain the relative position of parts 4 and 7; and through them, the distance of head 2 relative to platen 7 is maintained. Reference numeral 26 denotes a screw to arrest the position of a cam (5 or 6) on rod 4. FIG. 2 illustrates also a slide sheet 27 onto which the frame 9 is slid into position when inserted in the case.

The invention is not limited to the embodiments described above; but all changes and modifications thereof, not constituting departures from the spirit and scope of the invention, are intended to be included.

We claim:

1. In a matrix printer, the combination comprising:

a print case;

a platen roller journaled in the case, there being means (i) defining and providing a physical representation of a roller position in the case;

a frame slidably mounted in the case and in a first particular direction toward said platen roller;

a guide rod mounted on said frame;

a print head with carriage movably disposed on the rod, the rod extending transversely to said direction, said direction being parallel to a direction of printing by said head;

a drive for the print head, drivingly coupled to the head and being mounted on the frame; and means (ii) on the frame for engaging said roller-position-defining means (i) to, thereby, establish a particular position of the frame and a particular distance as between the print head as mounted by means of the carriage on the rod of the frame and the platen roller, at least one of the means (i) and (ii) being adjustable to, thereby, adjust said distance established upon said engaging.

2. The combination as in claim 1, the means (ii) including a pair of eccentric, cam-like disks, the means (i) being plates carrying the platen roller, there being spring means effective between the frame and the case to urge the cams against the plates.

3. The combination as in claim 1 or 2, a paper feed drive being mounted on the frame, there being a key connection to establish a driving connection between the roller and the drive for variable positions of the frame relative to the case.

* * * * *